US008649714B2

(12) United States Patent
Kudo et al.

(10) Patent No.: US 8,649,714 B2
(45) Date of Patent: Feb. 11, 2014

(54) DEVELOPMENT DEVICE, PROCESS CARTRIDGE, AND IMAGE FORMING APPARATUS INCLUDING SAME

(75) Inventors: Norio Kudo, Kanagawa (JP); Yasuo Miyoshi, Kanagawa (JP); Hiroshi Hosokawa, Kanagawa (JP); Yoshihiro Fujiwara, Kanagawa (JP); Hiroaki Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 249 days.

(21) Appl. No.: 13/207,776

(22) Filed: Aug. 11, 2011

(65) Prior Publication Data

US 2012/0051793 A1 Mar. 1, 2012

(30) Foreign Application Priority Data

Aug. 31, 2010 (JP) ..... 2010-193962

(51) Int. Cl.
*G03G 15/09* (2006.01)

(52) U.S. Cl.
USPC ..... 399/277

(58) Field of Classification Search
USPC ..... 399/254, 272, 273, 274, 277, 283, 284
See application file for complete search history.

(56) References Cited

U.S. PATENT DOCUMENTS

| | | | | |
|---|---|---|---|---|
| 5,715,504 | A * | 2/1998 | Sahay | 399/277 |
| 6,259,876 | B1 * | 7/2001 | Fukuda et al. | 399/254 |
| 6,360,068 | B1 * | 3/2002 | Kinoshita et al. | 399/284 |
| 7,536,141 | B2 | 5/2009 | Miyoshi | |
| 7,599,649 | B2 | 10/2009 | Miyoshi | |
| 7,697,870 | B2 | 4/2010 | Hosokawa et al. | |
| 7,769,326 | B2 | 8/2010 | Miyoshi | |
| 7,877,047 | B2 | 1/2011 | Miyoshi | |
| 7,957,678 | B2 | 6/2011 | Hosokawa et al. | |
| 7,995,954 | B2 | 8/2011 | Kudo et al. | |
| 2009/0010662 | A1 * | 1/2009 | Naoi et al. | 399/44 |
| 2009/0169264 | A1 | 7/2009 | Miyoshi et al. | |
| 2009/0238610 | A1 | 9/2009 | Miyoshi et al. | |

(Continued)

FOREIGN PATENT DOCUMENTS

| | | | |
|---|---|---|---|
| JP | 11-184249 | | 7/1999 |
| JP | 2006146013 | A * | 6/2006 |

OTHER PUBLICATIONS

Mahine translation of Yoshida, JP 2006-146013.*

*Primary Examiner* — David Gray
*Assistant Examiner* — Sevan A Aydin
(74) *Attorney, Agent, or Firm* — Oblon, Spivak, McClelland, Maier & Neustadt, L.L.P.

(57) ABSTRACT

A development device includes a developer bearer to carry by rotation two-component developer to a development range to develop a latent image formed on a latent image bearer, a magnetic field generator disposed inside the developer bearer, a developer regulator for adjusting an amount of the developer on the developer bearer, positioned upstream from the development range in a rotational direction of the developer bearer and facing the developer bearer across a regulation gap, a supply compartment from which the developer is supplied by a developer agitator to the developer bearer, a collection compartment, a pre-regulation portion adjacent to and upstream from the developer regulator in the rotational direction of the developer bearer, and a developer mobility adjuster that makes mobility of the developer in the pre-regulation portion higher on an upstream side in a developer conveyance direction in the supply compartment.

7 Claims, 5 Drawing Sheets

(56) References Cited

U.S. PATENT DOCUMENTS

| | | | |
|---|---|---|---|
| 2010/0119264 | A1 | 5/2010 | Yamaguchi et al. |
| 2010/0129113 | A1 | 5/2010 | Sampe et al. |
| 2010/0202805 | A1 | 8/2010 | Miyoshi et al. |
| 2010/0215397 | A1 | 8/2010 | Sampe et al. |
| 2010/0215401 | A1 | 8/2010 | Fujiwara et al. |
| 2011/0008073 | A1 | 1/2011 | Kudo et al. |
| 2011/0026973 | A1 | 2/2011 | Hosokawa et al. |
| 2011/0150525 | A1 | 6/2011 | Fujiwara et al. |

* cited by examiner

DEVELOPMENT DEVICE, PROCESS CARTRIDGE, AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2010-193962, filed on Aug. 31, 2010, in the Japan Patent Office, the entire disclosure of which is hereby incorporated herein by reference.

FIELD OF THE INVENTION

The present invention generally relates to a development device using two-component developer consisting essentially of toner and carrier, a process cartridge including the same, and an image forming apparatus, such as a copier, a printer, a facsimile machine, or a multifunction machine having at least two of these capabilities, that includes the same.

BACKGROUND OF THE INVENTION

Development devices using two-component developer typically include a developer container in which developer is contained, a rotary developer bearer such as a development roller, and a developer conveyance member such as a conveyance screw provided in the developer container. The developer conveyance member supplies developer to the developer bearer while transporting the developer through a developer supply compartment (i.e., a developer supply path) inside the developer container in an axial direction of the developer bearer. Then, the developer bearer rotates and supplies the developer carried thereon to a development range facing an image bearer such as a photoreceptor. After having passed through the development range and toner therein has been consumed, the developer (hereinafter "used developer") is collected either in the supply compartment (hereinafter "single-conveyance path method") or a collection compartment separate from the supply compartment (hereinafter "supply-collection separation method").

The single-conveyance path method has a drawback in that the concentration of toner in the developer in the supply compartment decreases downstream in a direction in which the developer is transported (hereinafter "developer conveyance direction"). Accordingly the concentration of toner in the developer supplied to the development range is uneven in the axial direction of the developer bearer (it is to be noted that hereinafter the terms "downstream" and "upstream" used in this specification mean those in the developer conveyance direction unless otherwise specified). Such unevenness in the toner concentration causes unevenness in image density of images formed on sheets of recording media and is undesirable. In particular, currently, images of higher printing ratio, such as photographs, are output more frequently than images of lower printing ratio, such as those include mainly text. Images of higher printing ratio consume more toner, with the result that the concentration of toner in the developer tends to become uneven, and the unevenness in image density resulting from the uneven toner concentration tends to be more visible.

To solve the problem described above, for example, JP-H11-184249-A employs a supply-collection separation method in which used developer is collected in the collection compartment separate from the supply compartment (hereinafter "a supply-collection separation type development device"). In the supply-collection separation method, the concentration of toner in the developer in the supply compartment can be kept substantially constant in the developer conveyance direction. Thus, the concentration of toner in the developer supplied to the development range can be kept uniform in the axial direction of the developer bearer.

Still, image density can become uneven in the axial direction of the developer bearer in supply-collection separation type development devices when the fluidity of the developer is reduced due to deterioration of the developer over time or from environmental factors.

In the supply-collection separation type development devices, because the developer is supplied to the developer bearer while being transported through the developer supply compartment, the amount of the developer flowing in the developer supply compartment decreases downstream. In other words, the amount of developer in the supply compartment is greater on the upstream side than on the downstream side in the developer conveyance direction. Where the amount of developer is greater, the mobility of the developer is lower.

Thus, in supply-collection separation type development devices, there is a portion where the mobility of the developer is lower in the developer conveyance direction, that is, in the axial direction of the developer bearer. In such a portion, the amount of the developer that passes through a regulation gap tends to drop.

To restrict the drop in the amount of developer that passes through the regulation gap, resulting from the decrease in the fluidity of the developer, the force for transporting the developer in the rotational direction of the developer bearer may be increased by increasing the magnetic force exerted by the magnetic field generator or abrading the surface of the developer bearer. However, such approaches can increase the stress on the developer, thus accelerating the degradation of the developer.

BRIEF SUMMARY OF THE INVENTION

In view of the foregoing, one illustrative embodiment of the present invention provides a development device using two-component developer including toner and magnetic carrier particles. The development device includes a cylindrical developer bearer to carry by rotation the developer to a development range where the developer bearer faces a latent image bearer to develop a latent image formed thereon, a magnetic field generator disposed inside the developer bearer for generating magnetic force, a developer regulator for adjusting an amount of the developer carried on the developer bearer, a supply compartment from which the developer is supplied to the developer bearer, a developer agitator provided in the supply compartment for transporting the developer in an axial direction of the developer bearer, a collection compartment to which the developer is collected after the developer passes through the development range, a pre-regulation portion adjacent to and upstream from the developer regulator in a rotational direction of the developer bearer, and a developer mobility adjuster for adjusting mobility of the developer. The developer regulator is positioned upstream from the development range in the rotational direction of the developer bearer and facing a circumferential surface of the developer bearer across a regulation gap, and the supply compartment is disposed adjacent to the developer bearer and extending parallel thereto in the axial direction of the developer bearer. The developer mobility adjuster makes mobility of the developer in the pre-regulation portion higher on an upstream side in a developer conveyance direction in the supply compartment than on a downstream side in the developer conveyance direction in the supply compartment.

In another embodiment, the development device described above and the latent image bearer are housed in a common unit casing as a process cartridge.

In another embodiment, an image forming apparatus includes the development device described above and the latent image bearer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
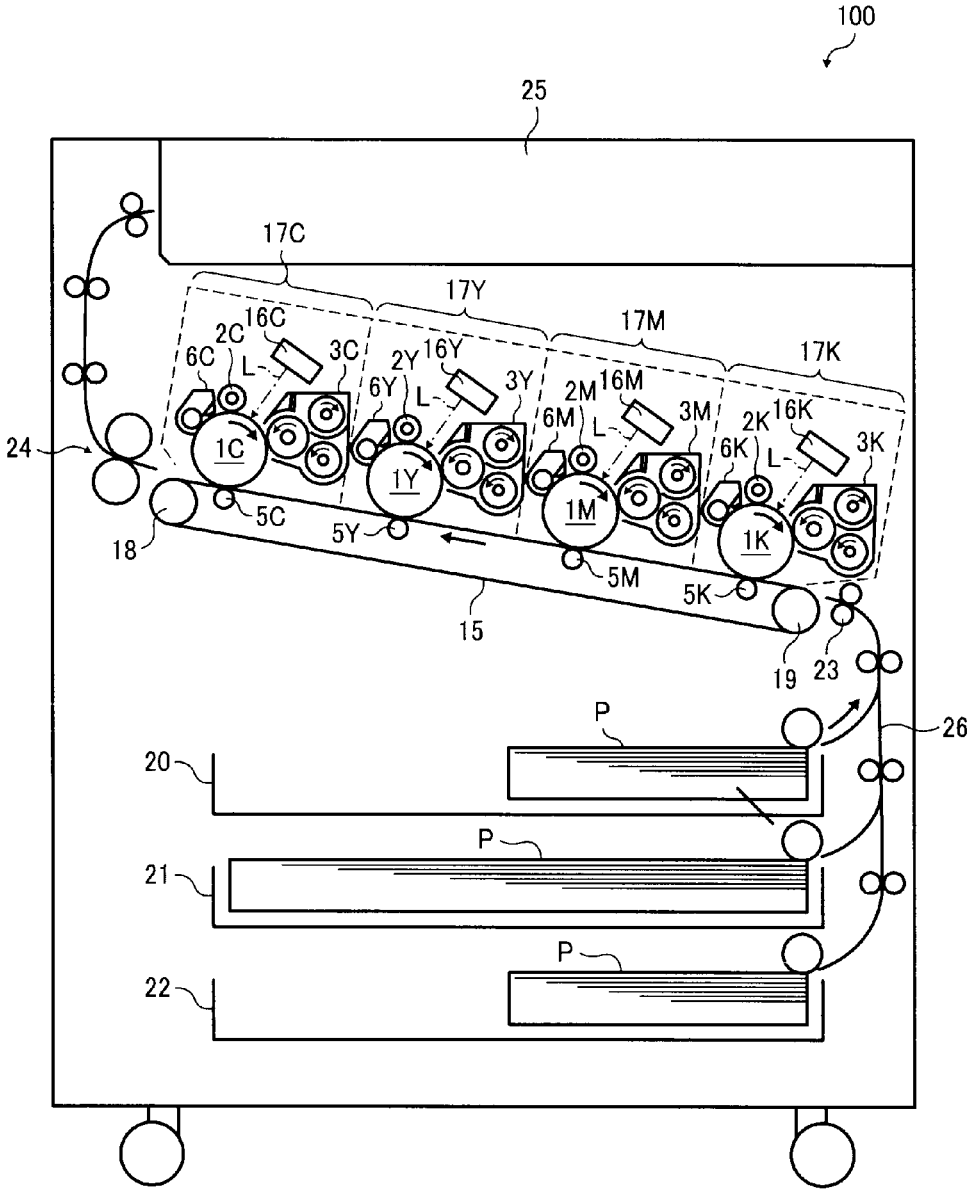
FIG. 1 is a schematic diagram illustrating an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram that illustrates a configuration of an image forming apparatus 100 according to the present embodiment.

The image forming apparatus 100 is a tandem-type multicolor image forming apparatus and includes four image forming units 17K, 17M, 17Y, and 17C for forming black (K), magenta (M), yellow (Y), and cyan (C) single-color toner images, respectively. An endless transfer-transport belt 15 is provided beneath the image forming units 17 and winds around support rollers 18 and 19. An upper side of the transfer-transport belt 15 rotates in a direction indicated by an arrow shown in FIG. 1 (hereinafter "belt travel direction") while carrying a sheet P (recording medium) thereon. Transfer bias rollers 5K, 5M, 5Y, 5C are provided facing the respective image forming units 17K, 17M, 17Y, and 17C via the transfer-transport belt 15.

The image forming apparatus 100 further includes a fixing device 24, disposed downstream from the downstream support roller 18 in the belt travel direction, and a discharge tray 25 formed on an upper side of the main body of the image forming apparatus 100. The fixing device 24 fixes a toner image on the sheet P thereon after the sheet P is separated from the transfer-transport belt 15, after which the sheet P is discharged onto the discharge tray 25.

The image forming apparatus 100 further includes sheets cassettes 20, 21, and 22 each containing multiple sheets P, a feed unit 26 to feed the sheets P from the sheets cassettes 20, 21, and 22 to the image forming units 17, and a pair of registration rollers 23. The registration rollers 23 forward the sheet P sent from the sheet cassettes 20 through 22 to a transfer positions where the transfer-transport belt 15 faces the respective image forming units 17.

In the image forming apparatus 100 according to the present embodiment, the transfer-transport belt 15 is disposed obliquely to transport the sheet P obliquely as indicated by an arrow shown in FIG. 1, and thus the lateral size of the image forming apparatus 100 in FIG. 1 is reduced. With this configuration, the width (lateral length in FIG. 1) of the image forming apparatus 100 can be only a length slightly greater than the length of A3 sheets in their longitudinal direction. In other words, the size of the image forming apparatus 100 can be significantly reduced to such a size as necessary to contain the sheets.

Each image forming unit 17 includes a drum-shaped photoreceptor 1 serving as a latent image bearer. A charger 2 to charge a surface of the photoreceptor 1, a developing device 3 to develop an electrostatic latent image formed on the photoreceptor 1, and a cleaning unit 6 to clean the surface of the photoreceptor 1 are provided around the photoreceptor 1. An exposure unit 16 directs writing light (e.g., a writing beam) L onto the surface of each photoreceptor 1 between the charger 2 and the development device 3. Thus, each image forming unit 17 has a known configuration. As the photoreceptor 1, belt-shaped photoreceptors may be used instead of drum-shaped photoreceptors.

In the above-described image forming apparatus 100, when users instruct the image forming apparatus 100 to start image formation, each image forming unit 17 starts to form a single color toner image. More specifically, in each image forming unit 17, the photoreceptor 1 is rotated by a main motor, not shown, and is charged uniformly at a position facing the charger 2 as the charging process. Then, the exposure unit 16 directs the writing beam L onto the photoreceptor 1 according to yellow, cyan, magenta, or black image data decomposed from multicolor image data, thus forming an electrostatic latent image thereon. The latent image is then developed by the development device 3. Thus, single-color toner images are formed on the respective photoreceptors 1. While the processes described above are performed, the sheets P are fed one by one from one of the sheet cassettes 20 through 21 by the feed unit 26 to the registration rollers 23, which forward the sheet P to the transfer-transport belt 15, timed to coincide with the arrival of the toner images formed on the respective photoreceptors 1. Then, the transfer-transport belt 15 transports the sheet P to the respective transfer positions.

When the surface of each photoreceptor drum 1 carrying the toner image reaches a position facing the transfer bias roller 5 via the transfer-transport belt 15, the toner image is transferred by the bias applied by the transfer bias roller 5 from the photoreceptor 5 onto the transfer-transport belt 15. Thus, the black, magenta, yellow, and cyan toner images are sequentially transferred from the respective photoreceptors 1 and superimposed one on another on the sheet P, forming a multicolor toner image on the sheet P. The sheet P on which the multicolor toner image is formed is then separated from the transfer-transport belt 15, and then the fixing device 24 fixes the image on the sheet P thereon, after which the sheet P is discharged onto the discharge tray 25.

After the toner image is transferred from each photoreceptor 1, the cleaning unit 6 removes any toner remaining thereon, and a discharge lamp (not shown) removes electrical potentials remaining on the photoreceptor 1 as required. Then, the charger 2 again charges the surface of the photoreceptor 1.

The development device 3 is described in further detail below.

The development devices 3K, 3M, 3Y, and 3C have a similar configuration except that the color of the toner used therein is different. It is to be noted that the photoreceptor 1 and the development device 3 can be housed in a common unit casing as a process cartridge, and one or more of other components of the image forming unit 17 may be also integrated as the process cartridge.

Figure 2:
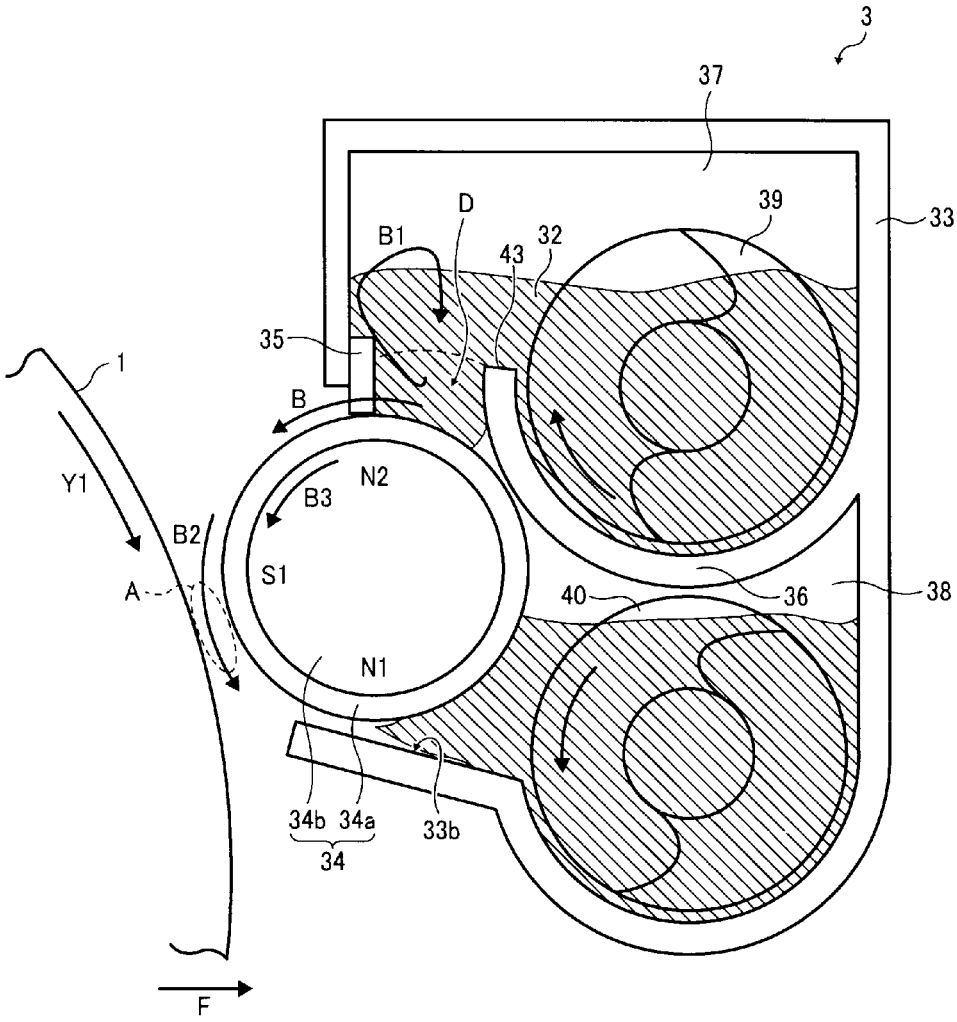
FIG. 2 is a schematic end-on axial view of a development device usable in the image forming apparatus shown in FIG. 1.
Figure 3:
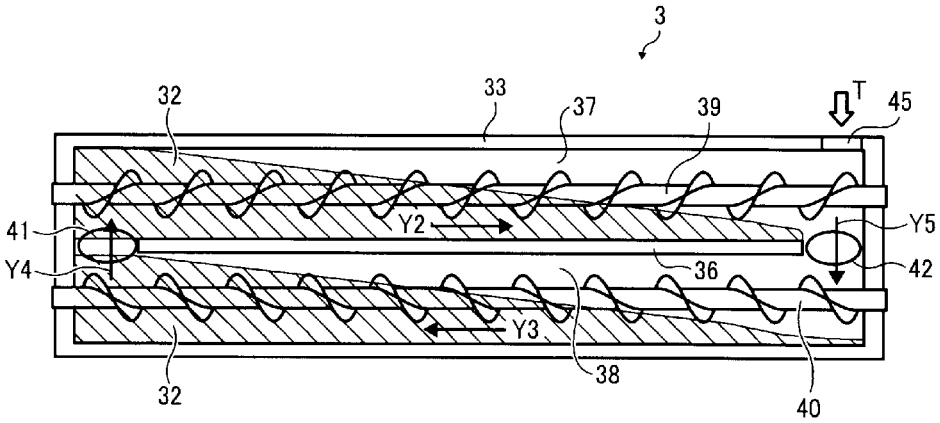
FIG. 3 is a cross-sectional view illustrating a portion adjacent to rotary shafts of developer conveyance screws as viewed in the direction indicated by arrow F shown in FIG. 2.
Figure 4:
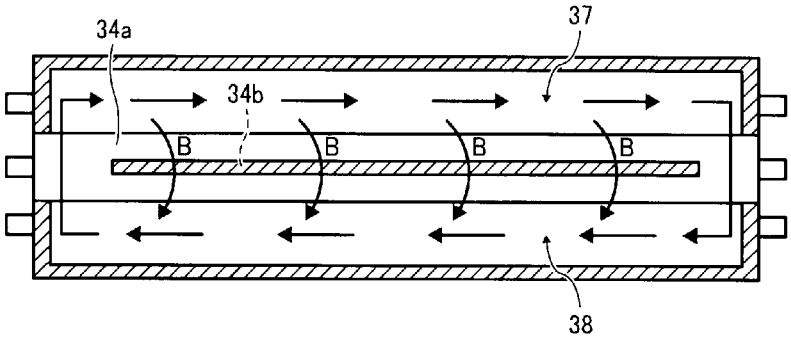
FIG. 4 illustrates a flow of the developer in a casing of the development device as viewed in the direction indicated by arrow F shown in FIG. 2.

FIG. 2 is a schematic end-on axial view of a configuration of the development device 3 usable in the image forming apparatus 100 in the present embodiment. FIG. 3 is a cross-sectional view illustrating a portion adjacent to rotary shafts of developer conveyance screws as viewed in the direction indicated by arrow F shown in FIG. 2. FIG. 4 illustrates a flow of the developer in a casing 33 of the development device 3 as viewed in the direction indicated by arrow F shown in FIG. 2.

In FIGS. 3 and 4, arrows indicate the flow of the developer in the casing 33 of the development device 3.

The development device 3 is disposed facing the photoreceptor 1 that rotates clockwise in FIG. 2, as indicated by arrow Y1 in FIG. 2. The casing 33 of the development device 3 contains two-component powdered developer 32 including magnetic carrier particles and magnetism or nonmagnetic toner particles. The development device 3 includes a development sleeve 34*a*, serving as a developer bearer, that carries developer 32 contained in the casing 33 on its circumferential surface and transports it by rotation to a development range A for supplying toner to the electrostatic latent image formed on the photoreceptor 1. The development sleeve 34*a* is cylindrical, and the term "cylindrical" used in this specification is not limited to round columns but also includes polygonal prisms although it is round in the configuration shown in the drawings.

A magnet roller 34*b* serving as a magnetic field generator is provided inside the development sleeve 34*a*. The magnet roller 34*b* is formed with multiple magnets fixed in position relative to the development device 3. The development sleeve 34*a* and the magnet roller 34*b* together form a development roller 34. The development device 3 further includes a developer regulator 35 to adjust the amount (e.g., layer thickness) of the developer 32 carried on the development sleeve 34*a*.

In the present embodiment, the magnet roller 34*b* includes three magnetic poles S1, N1, and N2 arranged in that order in the direction indicated by arrow B3 shown in FIG. 2, in which the development sleeve 34*a* rotates. The magnetic pole S1 serves as a development pole (hereinafter also "development pole S1") that causes the developer 32 that passes through the development range A to stand on end on the development sleeve 34*a* to bring the toner particle adsorbed to the magnetic carrier into contact with the surface of the photoreceptor 1, thus developing the latent image into a toner image. The magnetic pole N1 serves as a release pole (hereinafter also "release pole N1") that secures conveyance of the developer 32 by the development sleeve 34*a* and separates the developer 32 from the surface of the development sleeve 34*a*.

The magnetic pole N2 is an attraction and regulation pole (hereinafter also "attraction and regulation pole N2") that serves a pump-up pole or attraction pole for generating a magnetic force (hereinafter "attractive magnetic force") to move the developer 32 to a buffer portion D and to pump up the developer onto the circumferential surface of the development sleeve 34*a* as well as a regulation pole for generating a magnetic force (hereinafter "regulation magnetic force") for securing that a predetermined amount of developer can passes through a regulation gap, which is the gap between the developer regulator 35 and the circumferential surface of the development sleeve 34*a*. The attraction and regulation pole N2 may be positioned adjacent to the developer regulator 35.

The development device 3 further includes two developer conveyance members, namely, a supply screw 39 and a collecting screw 40, both disposed in substantially parallel to an axis of rotation of the development sleeve 34*a*. Each of the supply screw 39 and the collecting screw 40 includes a rotary shaft and a bladed spiral provided on the shaft and transports the developer unidirectionally along the rotary shaft (hereinafter "developer conveyance direction") while rotating. An inner wall of the development casing 33 as well as a partition 36 divide the space inside the casing 33 into a supply compartment (developer supply path) 37 and a collection compartment (developer collection path) 38 arranged vertically across the partition 36.

In addition, as shown in FIG. 3, openings 41 and 42 (communication portions) are formed in both end portions of the partition 36. Through the opening 41, an upstream end portion of the supply compartment 37 in the developer conveyance direction therein communicates with a downstream end portion of the collection compartment 38 in the developer conveyance direction therein. Through the opening 42, an upstream end portion of the collection compartment 38 in the developer conveyance direction therein communicates with a downstream end portion of the supply compartment 37 in the developer conveyance direction therein. A toner supply inlet 45 through which toner T is supplied to the development device 3 is formed in the casing 33 above the opening 42.

Additionally, an end portion of the partition 36 on the side of the development sleeve 34*a* stands vertically in FIG. 2 to enclose the supply screw 39 and thus forms a barrier 43. The developer 32 is sequentially supplied from the supply compartment 37 to a pre-regulation space D above the development sleeve 34*a* defined by the barrier 43, an inner wall of the development device 3, and an upper circumferential surface of the development sleeve 34*a*.

The pre-regulation space D means a space adjacent to and upstream from the developer regulator 35 in the direction of rotation of the development sleeve 34*a*. The pre-regulation space D above the development sleeve 34*a* extends over the entire axial length of the development sleeve 34*a* so that the developer 32 retained in the pre-regulation space D can contact and be carried on the circumferential surface of the development sleeve 34*a* over the entire axial length of the development sleeve 34*a* as the development sleeve 34*a* rotates. The pre-regulation space D (hereinafter also "buffer D") above the development sleeve 34*a* can temporarily store the developer 32 supplied from the supply compartment 37 and supply the developer 32 to the development sleeve 34*a* reliably.

In the present embodiment, because the amount of the developer 32 in the supply compartment 37 tends to decrease downstream in the developer conveyance direction therein, the height of the barrier 43 may be reduced downstream in the developer conveyance direction. Referring to FIG. 3, the collecting screw 40 transports the developer 32 in the collection compartment 38 in the direction indicated by arrow Y3, opposite the direction indicated by arrow Y2 in which the supply screw 39 transports the developer 32. In FIG. 2, the supply screw 39 rotates clockwise, and the collecting screw 40 rotates counterclockwise similarly to the development sleeve 34*a*. Referring to FIG. 4, as the supply screw 39 and the collecting screw 40 rotate, the developer 32 is transported in the respective directions in the supply compartment 37 and the collection compartment 38, thus circulated in the casing 33.

In the downstream end portion of the collection compartment 38 in the developer conveyance direction, the developer accumulates and is pushed up vertically, as indicated by arrow Y4 shown in FIG. 3, by a conveyance pressure exerted by the collecting screw 40 provided in the collection compartment 38 through the opening 41 to the supply compartment 37. In the supply compartment 37, as the supply screw 39 rotates, the developer 32 is supplied to the buffer D beyond the end portion of the barrier 43 between the supply screw 39 and the development sleeve 34*a*. In the buffer D, the developer 32 is supplied to the development sleeve 34*a* directly, or indirectly attracted by the magnetic force exerted by the magnet roller 34*b* provided inside the development sleeve 34*a*.

Since the attractive magnetic force generated by the attraction and regulation pole N2 can exert the force for transporting the developer from the supply compartment 37 to the development sleeve 34*a*, the developer can be reliably transported to the development sleeve 34*a*.

Further, the supply compartment 37 is positioned above the development sleeve 34*a* so that the weight of the developer can be also used to transport the developer from the supply compartment 37 to the development sleeve 34*a*, the developer can be reliably transported to the development sleeve 34*a* even when the attractive magnetic force is reduced by the amount corresponding to the weight of the developer.

Thus, the magnetic flux density of the attraction and regulation pole N2 can be reduced to reduce the stress on the developer, alleviating the degradation of the developer.

The developer 32 supplied to the development sleeve 34*a* via the buffer D is carried on the circumferential surface of the development sleeve 34*a* and is conveyed in the direction indicated by arrow B shown in FIG. 2 by the rotation of the development sleeve 34*a* as well as the magnetic force exerted by the magnetic roller 34*b*. Then, a predetermined constant amount of developer 32 passes through the regulation gap between the surface of the development sleeve 34*a* and the developer regulator 35 as indicated by arrow B, being carried on the development sleeve 34*a*. The developer regulator 35 blocks excessive developer among the developer 32 carried on the surface of the development sleeve 34*a*, and the developer blocked by the developer regulator 35 is retained in the buffer D.

Subsequently, the developer passes through the development range A as indicated by arrow B2, after which the developer 32 leaves the development sleeve 34*a*, flows down to a bottom portion 33*b* of the casing 33, and thus enters the collection compartment 38. More specifically, the developer 32 that has passed through the regulation gap further passes through the development range A, carried on the development sleeve 34*a*. The developer 32 that is not supplied to the photoreceptor 1 but remains on the development sleeve 34*a* after passing through the development range A is collected in the collection compartment 38 instead of being transported to the supply compartment 37 immediately as the development sleeve 34*a* rotates. In the collection compartment 38, the collected developer 32 is mixed with fresh toner supplied thereto and again sent to the supply compartment 37. The developer 32 that has passed through the development range A is thus circulated in the casing 33 (i.e., the supply compartment 37 and the collection compartment 38). Accordingly, only the developer that has been agitated sufficiently in the collection compartment 38 can be supplied to the supply compartment 37.

In the present embodiment, as the development sleeve 34*a* rotates, the developer 32 passes through the development range A, leaves the development sleeve 34*a* at a portion facing the collection compartment 38, and is collected therein. Thus, the collection compartment 38 contains the developer 32 of reduced toner concentration because the toner therein has been consumed while it passes through the development range A. Therefore, fresh toner is supplied to the upstream portion of the collection compartment 38 in the developer conveyance direction in response to the toner consumption calculated based on data of latent images or detection results of the concentration of toner in the collection compartment 38.

As shown in FIG. 3, the toner supplied from the toner supply inlet 45 to the casing 33 drops through the opening 42, as indicated by arrow Y5 shown in FIG. 3, to the upstream end portion of the collection compartment 38 in the developer conveyance direction. The supplied toner is mixed with the developer 32 present in the collection compartment 38 while being transported through the collection compartment 38. Thus, the developer 32 having a proper toner concentration can be supplied to the supply compartment 37.

As described above, because the developer of reduced toner concentration that has passed through the development range A is not collected in the supply compartment 37, the concentration of toner in the developer 32 in the supply compartment 37 can be substantially constant in the developer conveyance direction by the supply screw 39.

In the development device 3 of supply-collection separation type, in which the collection compartment 38 is provided separately from the supply compartment 37, the developer can be supplied from the supply compartment 37 through the buffer D to the development sleeve 34*a* over the entire axial length of the supply compartment 37 as indicated by arrow B shown in FIG. 4. Therefore, the amount of the developer 32 transported by the supply screw 39 in the supply compartment 37 decreases gradually as the developer 32 flows downstream in the supply compartment 37. In other words, the amount of developer is greater on the upstream side in the supply compartment 37 than in the downstream side.

Accordingly, the amount of developer moving to the buffer D is greater on the upstream side in the supply compartment 37 relatively to the downstream side thereof. As a result, in a portion of the buffer D facing the upstream side in the supply compartment 37, the space for the developer to move is reduced, and the mobility of the developer therein is lower compared with a portion of the buffer D facing the downstream side in the supply compartment 37, in which the space for the developer to move is larger because the amount of developer is smaller. In the buffer D, which is the pre-regulation space adjacent to and upstream from the regulation gap as described above, the drop in the amount of developer that passes through the regulation gap is greater in portions where the mobility (degree of ease of movement) of developer is low when the fluidity of the developer is reduced.

Thus, when the fluidity of the developer is reduced due to the deterioration of the developer over time or environmental changes, the decrease in the amount of developer that passes through the regulation gap is different between the upstream side and the downstream side in the supply compartment 37. Therefore, the amount of the developer supplied to the development range A fluctuates in the axial direction of the development sleeve 34*a*, resulting in the unevenness in image density.

It is to be noted that the unevenness in image density in the axial direction is caused not only in the above-described configuration but also in configurations in which the mobility of the developer before passing through the regulation gap can become uneven in the axial direction of the developer bearer.

In view of the foregoing, in the present embodiment, the magnetic fields of the development roller 34 are arranged so that the mobility of the developer in the upstream portion of the buffer D facing the upstream side in the supply compartment 37, where the amount of the developer that passes through the regulation gap is likely to drop when the fluidity of the developer is reduced, can be higher than the mobility of developer in the downstream portion of the buffer D facing the downstream side in the supply compartment 37, thereby alleviating the fluctuation in the amount of the developer that passes through the regulation gap when the fluidity of the developer is reduced.

More specifically, the developer contained in the supply compartment 37 overstrides the barrier 43 between the supply compartment 37 and the development sleeve 34*a* and moves to the buffer D while being transported by the rotation of the supply screw 39. Then, in the buffer D, the developer is conveyed to the regulation gap between the developer regulator 35 and the surface of the development sleeve 34*a* due to the rotation of the development sleeve 34*a* as well as the magnetic force exerted by the attraction and regulation pole N2 for attracting the developer and regulating the amount of the developer.

In the present embodiment, the development sleeve 34*a* has a relatively small diameter and is 12 mm or less, for example. When such small diameter development sleeves are used, the development sleeve is more liable to deform, affected by the magnetic force attracting the developer to the surface of the development sleeve or the weight of the developer in the buffer D. Therefore, it is preferred to reduce the load to the development sleeve 34*a*.

Herein, the developer carried on the surface of the development sleeve 34*a* is caused to stand on end thereon by the magnetic force lines generated by the magnetic pole of the magnet roller 34*b*. More specifically, the developer particles magnetically stand on end on the development sleeve 34*a* adjacent to the position where the magnetic flux density on the development sleeve 34*a* in the direction normal to the circumferential surface of the development sleeve 34*a* (hereinafter "magnetic flux density in the normal direction") is the maximum, that is, the position adjacent to the circumferential surface of the development sleeve 34*a* where the magnetic flux density in the direction tangential to the circumferential surface of the development sleeve 34*a* (hereinafter "magnetic flux density in the tangential direction") is zero. By contrast, the developer particles lie on the development sleeve 34*a* adjacent to the position where the magnetic flux density in the tangential direction is the maximum, that is, the position on the circumferential surface of the development sleeve 34*a* where the magnetic flux density in the normal direction is zero.

Typically, to secure the amount of developer that passes through the regulation gap even when the fluidity of the developer is reduced, the magnetic flux density in the normal line direction of the attraction and regulation pole N2 is increased uniformly, thereby increasing the force for attracting the developer contained in the buffer D to the regulation gap. However, the magnetic restraint on the developer in the buffer D increases in this approach, and a relatively large stress is applied to the developer, thus accelerating the degradation of the developer.

By contrast, in such configurations in which the supply compartment 37 is positioned higher than the development sleeve 34*a* as in the present embodiment, because the weight of the developer can facilitate the movement of the developer to the buffer D, the developer can be conveyed reliably to the buffer D with a reduced magnetic force for attracting the developer compared with a configuration in which the developer is moved from the supply compartment 37 to the buffer D by the magnetic force exerted by the attraction and regulation pole N2 only. Therefore, in the present embodiment, the peak density in the normal direction of the magnetic flux generated by the attraction and regulation pole N2 is within a range of from 10 mT to 50 mT so that the developer can be moved reliably from the supply compartment 37 to the buffer D without applying an excessive stress on the developer.

Reduction in the magnetic flux density of the attraction and regulation pole N2, however, means the reduction in the magnetic force acting on the developer that passes through the regulation pole N2. Accordingly, simply reducing the magnetic force (the peak density in the normal direction) of the attraction and regulation pole N2 can cause a drop in the amount of the developer supplied to the development range A (the developer that passes through the regulation gap).

When the fluidity of developer decreases due to the degradation of the developer or environmental factors, the drop amount of the developer is different in the axial direction of the development sleeve 34*a*, making the image density uneven. More specifically, when the fluidity of developer is reduced, the amount of developer that passes through the regulation gap drops significantly on the upstream side in the supply compartment 37.

The features of the present embodiment, described below, can alleviate the difference in the amount of developer that passes through the regulation gap even in such a configuration in which the peak density in the normal direction of the magnetic flux is reduced and the drop amount of the developer tends to differ in the axial direction of the development sleeve 34*a* when the fluidity of the developer has decreased.

Figure 5B:
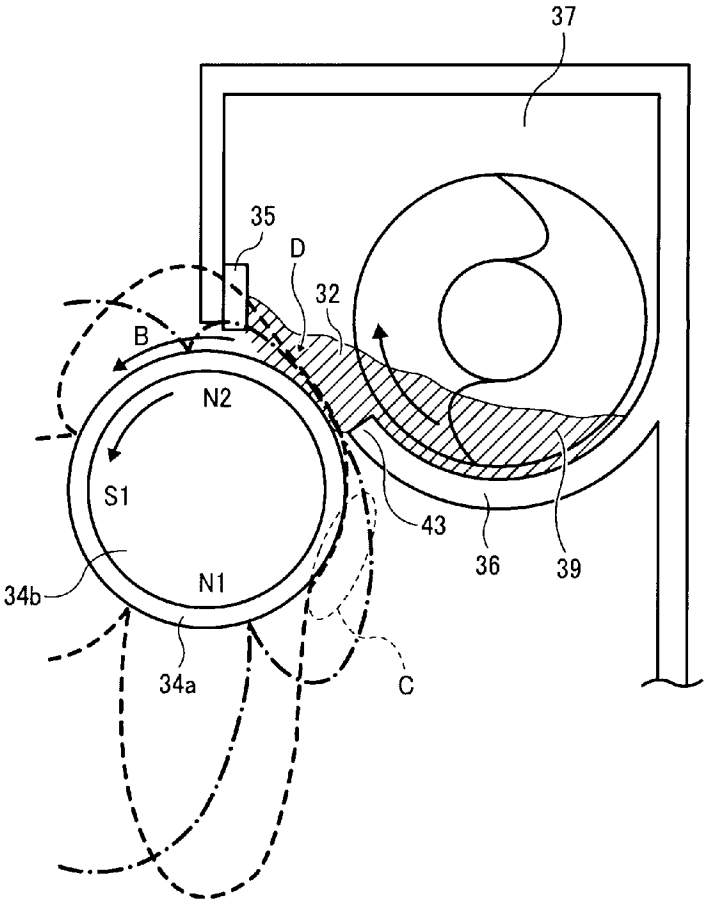
FIG. 5B is a cross-sectional view of the development device perpendicular to the axial direction of the development sleeve, and illustrates a downstream end portion of the supply compartment showing magnetic flux density in the normal direction and that in the tangential direction superimposed thereon.
Figure 5A:
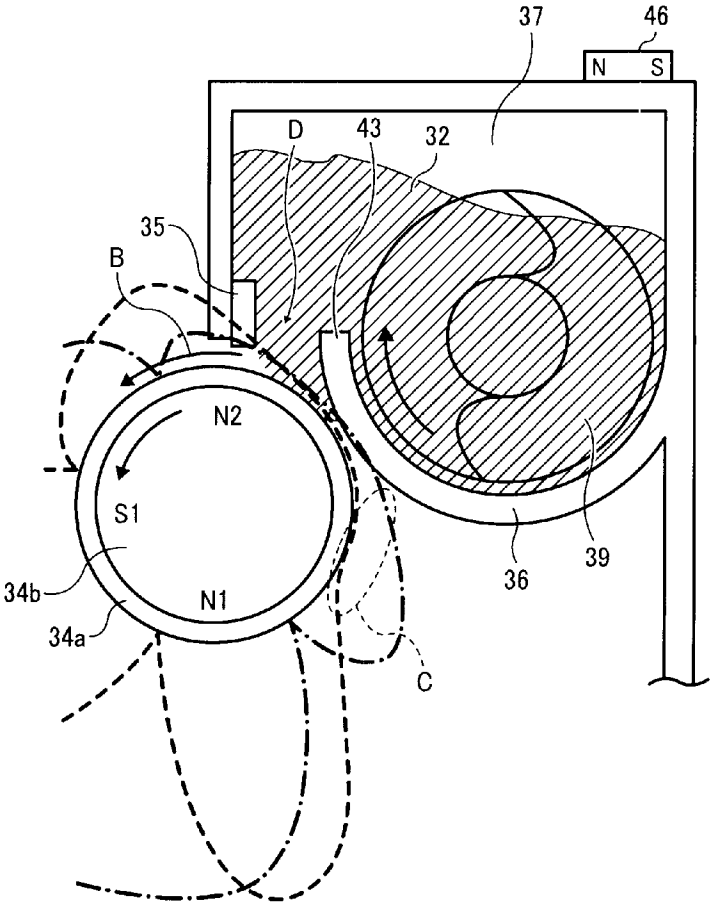
FIG. 5A is a cross-sectional view of the development device perpendicular to the axial direction of a development sleeve and illustrates an upstream end portion of a supply compartment showing magnetic flux density in the normal direction and that in the tangential direction superimposed thereon.

FIGS. 5A and 5B are cross-sectional views of the development device 3 perpendicular to the axial direction of the development sleeve 34*a*, and graphs of the magnetic flux density in the normal direction (broken lines) and the magnetic flux density in the tangential direction (alternate long and short dashed lines) are superimposed thereon. FIG. 5A illustrates the upstream end portion of the supply compartment 37, and FIG. 5B illustrates the downstream end portion of the supply compartment 37.

Referring to FIG. 5A, in the present embodiment, to address the above-described inconvenience, the position in the rotational direction of the development sleeve 34*a* corresponding to the peak of the magnetic flux density in the normal direction (hereinafter "normal-direction peak density position") of the magnetic flux generated by the attraction and regulation pole N2 on the upstream side in the supply compartment 37 is shifted downstream from that on the downstream side in the supply compartment 37 in the developer conveyance direction.

More specifically, as shown in FIG. 5A, an external magnet 46 is provided as a developer mobility adjuster on an upper surface of the casing 33 on the upstream side in the developer conveyance direction in the supply compartment 37. The external magnet 46 serves as an adjuster for adjusting the attractive magnetic force in the buffer (pre-regulation space) D and makes the normal-direction peak density position of the magnetic flux by the attraction and regulation pole N2 different between the upstream side and the downstream side in the developer conveyance direction by the supply screw 39. The normal-direction peak density position of the magnetic flux generated by the attraction and regulation pole N2 on the upstream side is shifted downstream in the rotational direction of the development sleeve 34*a*.

When the external magnet 46 is provided, the magnetic field on the upstream side in the supply compartment 37 in the developer conveyance direction changes as follows. The magnetic force lines generated by the release pole N1 and the attraction and regulation pole N2 partially enter the development pole S1. The rest of the magnetic force lines passes by a release portion C (adjacent to a position opposite the development pole S1 in the rotational direction of the development sleeve 34*a*), shown in FIGS. 5A and 5B, and moves away from the circumferential surface of the development sleeve 34*a*. Such a magnetic field is changed when the external magnet 46 having the same polarity as that of the attraction and regulation pole N2 is provided. That is, among the magnetic force lines generated by the attraction and regulation pole N2, those that pass by the release portion C and move away from the development sleeve 34*a* repel the magnetic force lines generated by the north (N) pole of the external magnet 46. Accordingly, those magnetic force lines generated by the attraction and regulation pole N2 are shifted toward the developer regulator 35. Consequently, the normal-direction peak density position of the magnetic flux generated by the attraction and regulation pole N2 is shifted downstream in the rotational direction of the development sleeve 34*a*.

Thus, by shifting the normal-direction peak density position of the magnetic flux generated by the attraction and regulation pole N2 on the upstream side in the buffer D in the developer conveyance direction of the supply screw 39 to the downstream side in the rotational direction of the development sleeve 34*a*, the magnetic force generated by the attraction and regulation pole N2 for retaining the developer in the buffer D can be reduced on the upstream side in the supply compartment 37 in the developer conveyance direction therein. Accordingly, the magnetic force restraining the developer in the buffer D, that is, the developer to pass through the regulation gap, can be attenuated, thus improving the mobility of the developer.

As a result, even when the fluidity of developer is reduced due to degradation of the developer or the like, the drop in the amount of developer that passes through the regulation gap can be alleviated on the upstream side in the developer conveyance direction in the supply compartment 37. Therefore, the difference in the amount of developer that passes through the regulation gap between the upstream side and the downstream side (the amount of the drop is smaller) in the developer conveyance direction in the supply compartment 37 can be reduced, and the unevenness in the image density can be reduced.

In addition, because the magnetic restraint exerted on the developer in the buffer D can be attenuated on the upstream side in the supply compartment 37, where the amount of developer is greater and the developer is more liable to receive stress, degradation of the developer can be slowed.

It is to be noted that, in the present embodiment, the magnetic force adjuster using the external magnet 46 adjusts the attractive magnetic force on the upstream side in the developer conveyance direction by the supply screw 39 to increase the mobility of the developer in the upstream portion of the buffer (pre-regulation space) D in the developer conveyance direction of the supply screw 39 than on the downstream side thereof. The adjuster for adjusting the attractive magnetic force is not limited to the external magnet 46. For example, the magnet roller 34*b* can be configured so that the magnetic flux density of the attraction and regulation pole N2 is smaller on the upstream side in the developer conveyance direction by the supply screw 39 than on the downstream side thereof, thereby reducing the magnetic force exerted by the attraction and regulation pole N2 for retaining the developer in the buffer D on the upstream side in the developer conveyance direction by the supply screw 39.

Next, a development device according to a variation of the above-described embodiment is described below with reference to FIGS. 6A and 6B.

Figure 6B:
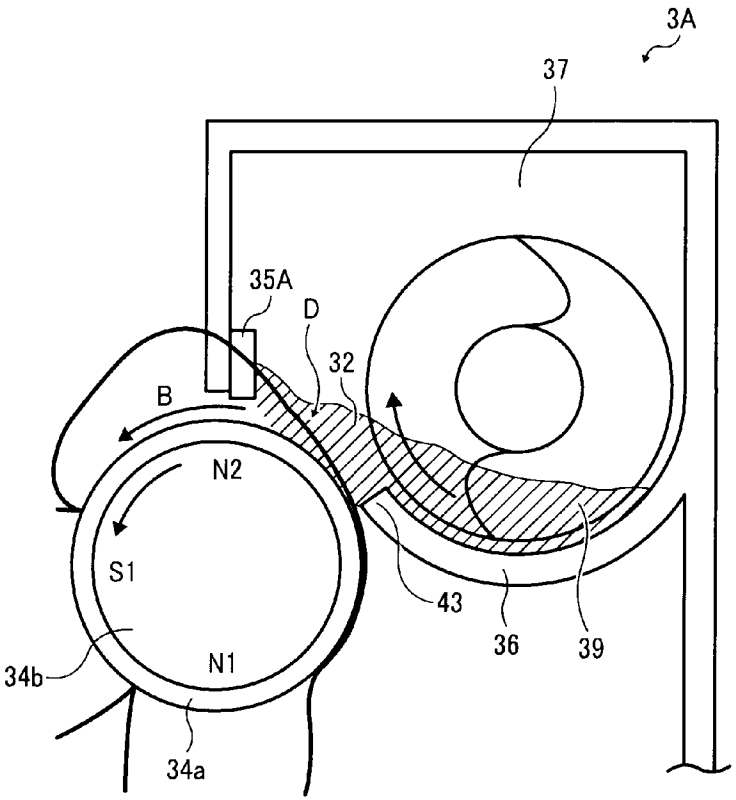
FIG. 6B illustrates a configuration of a downstream end portion of the supply compartment in the development device shown in FIG. 6A.
Figure 6A:
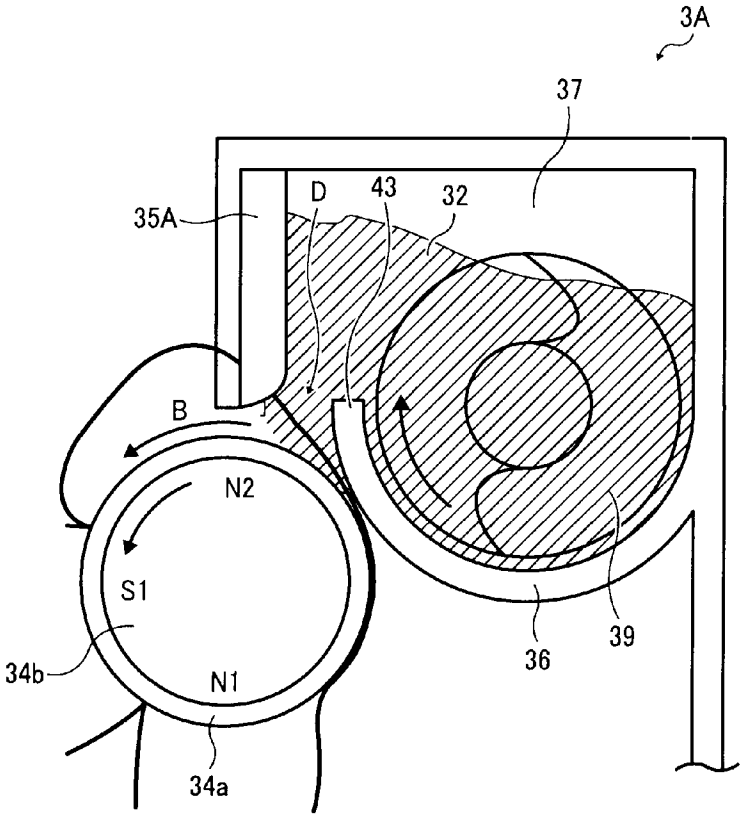
FIG. 6A illustrates a configuration of an upstream end portion of a supply compartment in a development device according to a variation.

FIG. 6A illustrates an upstream end portion of a supply compartment 37 in the development device 3A, and FIG. 6B illustrates a downstream end portion of the supply compartment 37.

As shown in FIG. 6A, the development device 3A according to the variation includes a developer regulator 35A having an end portion shaped like a wedge, that is, tapered toward the regulation gap. More specifically, a side of the developer regulator 35A facing the buffer D is tapered, and the tapered end portion is limited to only the upstream portion in the developer conveyance direction in the supply compartment 37. With this configuration, the space above the development sleeve 34*a* is gradually narrowed downstream in the rotational direction of the development sleeve 34*a*. Accordingly, the developer is less liable to remain in the buffer D on the downstream side in the developer conveyance direction in the supply compartment 37 compared with the downstream side in that direction on which the change in size of the space above the development sleeve 34*a* is sharp as shown in FIG. 6B.

As a result, the mobility of the developer in the buffer D, that is, the developer to pass through the regulation gap, can be improved on the upstream side in the developer conveyance direction of the supply screw 39, on which the amount of developer is greater and the mobility thereof is lower. Thus, even when the fluidity of developer is reduced due to degradation of the developer or the like, the drop in the amount of developer that passes through the regulation gap on the upstream side in the developer conveyance direction in the supply compartment 37 can be reduced. Therefore, the difference in the amount of developer that passes through the regulation gap between the upstream side and the downstream side (the amount of the drop is smaller) in the developer conveyance direction in the supply compartment 37 can be reduced, and the unevenness in the image density can be reduced.

It is to be noted that, although the mobility of developer in the buffer D is enhanced on the upstream side in the developer conveyance direction in the supply compartment 37 by the wedge-like distal end portion of the developer regulator 35A, the structure for attaining this effect is not limited thereto.

In the above-described embodiment and variation, even when the developer has deteriorated over time, the unevenness in the image density can be reduced when the mobility of the developer is enhanced in one fourth to one third of the buffer D (supply compartment 37) on the upstream side in the developer conveyance direction of the supply screw 39 either by shifting the normal-direction peak density position of the magnetic flux by the attraction and regulation pole N2 or with the tapered end portion of the developer regulator 35A.

It is to be noted that the mobility of the developer in the buffer D on the upstream side in the developer conveyance direction in the supply compartment 37 may be enhanced upstream either stepwise or consecutively.

In addition, the description above concerns the configuration in which the developer is transported unidirectionally from one end to the opposite end in the supply compartment 37 and the mobility of the developer in the end portion is enhanced to reduce the difference in the amount of developer that passes through the regulation gap between the portion where the mobility of developer is higher (generally, the amount of developer is smaller) and the portion where the mobility of developer is lower (generally, the amount of developer is greater).

By contrast, in configurations in which the developer is transported from both ends to a center portion in the supply compartment 37, the mobility of developer in the buffer D is enhanced in both end portions.

Further, the number of the magnetic poles of the magnet roller 34*b* is not limited to three as in the above-described embodiment and variation. For example, similar effects can be attained with magnet rollers having six magnetic poles.

Moreover, although the description above concerns the configuration in which the weight of developer is used to move the developer from the supply compartment 37 to the buffer D in addition to the attractive magnetic force by the attraction and regulation pole N2, a similar effect can be attained in configurations in which the supply compartment 37 is positioned lower than the development sleeve 34*a* and only the attractive magnetic force is used to move the developer from the supply compartment 37 to the buffer D.

As described above, the image forming apparatus 100 according to the above-described embodiment and the variation includes the photoreceptor 1 serving as the latent image bearer; the charger 2 and the exposure unit 16 together forming the latent image forming unit; and the development device 3 or 3A for developing the latent image formed on the photoreceptor 1 with the developer including the toner and the carrier. The image forming apparatus 100 transfers the toner image from the photoreceptor 1 to the recording sheet P (recording medium), thus forming an output image.

The development device 3 includes the development roller 34 including the development sleeve 34*a* serving as the developer bearer for transporting the developer by rotation to the development range A facing the photoreceptor 1 as well as the magnet roller 34*b* provided inside the development sleeve 34*a* for generating magnetic force around the circumferential surface of the development sleeve 34*a*, the doctor blade 35 positioned across the regulation gap from the surface of the development sleeve 34*a* for adjusting the amount of developer transported to the development range A, and the supply screw 39 for transporting the developer through the developer supply compartment 37 extending in the axial direction of the development sleeve 34*a*, along the development sleeve 34*a*. The developer is supplied by the supply screw 39 from the supply compartment 37 to the development sleeve 34*a* while being conveyed in the axial direction of the development sleeve 34*a*. Then, the developer passes through the regulation gap and is transported to the development range A, after which the developer is collected in the collection compartment 38 separate from the supply compartment 37.

The development device 3 further includes the developer mobility adjuster for adjusting the mobility of the developer in the buffer (pre-regulation space) D positioned adjacent to and upstream from the regulation gap in the rotational direction of the development sleeve 34*a*. The developer mobility adjuster makes the mobility of the developer higher on the upstream side than on the downstream side in the developer conveyance direction by the supply screw 39. Although the decrease in the amount of developer that passes through the regulation gap is different between the upstream side and the downstream side in the developer conveyance direction by the supply screw 39 when the fluidity of the developer is reduced due to the deterioration of the developer over time or environmental factors, the difference can be reduced by adjusting the mobility of the developer with the developer mobility adjuster. As a result, the axial unevenness in the amount of developer supplied to the development range A can be restricted even when the fluidity of the developer is reduced due to the degradation of the developer or the like. In addition, because the increase in the mobility of developer closely correlates with the decrease in the stress on the developer, the stress on the developer can be reduced effectively, thus slowing the deterioration of the developer, by enhancing the mobility of the developer in the portion where the amount of developer is greater and the stress on the developer is larger.

The magnet roller 34*b* includes the multiple magnetic poles S1, N1, and N2 arranged in the rotational direction of the development sleeve 34*a*. The magnetic pole (attraction and regulation pole) N2 generates a magnetic force that acts on both the developer that passes through the regulation gap and the developer that moves from the supply compartment 37 to the development sleeve 34*a*. The development sleeve 34*a* is positioned lower than the supply compartment 37 so that the developer can move down from the supply compartment 37 to the development sleeve 34*a* under its own weight. In this configuration, the magnetic force exerted by the attraction and regulation pole N2 can be smaller compared with a configuration in which the developer is supplied to the development sleeve 34*a* using only the magnetic force exerted by the attraction and regulation pole N2.

To achieve the function of the developer mobility adjuster, the magnet roller 34*b* may be configured so that, in the attraction portion where the developer in the supply compartment 37 moves to the circumferential surface of the development sleeve 34*a*, the attractive magnetic force generated by the attraction and regulation pole N2 is smaller on the upstream side in the conveyance direction of the supply screw 39 than the downstream side in that direction. Adjusting the magnetic force can achieve the adjustment of the mobility of the developer without a significant change in design of the device.

Further, to achieve the function of the developer mobility adjuster, the attractive magnetic force may be adjusted such that its normal-direction peak density position on the upstream side in the developer conveyance direction of the supply screw 39 is shifted to the downstream side in the rotational direction of the development sleeve 34*a* from the normal-direction peak density position on the downstream side in that direction. Thus, the magnetic force exerted by the attraction and regulation pole N2 for retaining the developer in the buffer D can be reduced on the upstream side in the developer conveyance direction in the supply compartment 37. Accordingly, the magnetic force restraining the developer in the buffer D, that is, the developer to pass through the regulation gap, can be attenuated, thus improving the mobility of the developer. As a result, even when the fluidity of developer is reduced due to degradation of the developer or the like, the drop in the amount of developer that passes through the regulation gap can be alleviated on the upstream side in the developer conveyance direction in the supply compartment 37. Therefore, the difference in the amount of developer that passes through the regulation gap between the upstream side and the downstream side (the amount of the drop is smaller) in the developer conveyance direction in the supply compartment 37 can be reduced, and the unevenness in the image density can be reduced.

In particular, as the developer mobility adjuster, when the external magnet 46 is provided outside the development sleeve 34*a* on the downstream side in the developer conveyance direction in the supply compartment 37, the attractive magnetic force can be adjusted with a simple configuration using the existing magnet roller 34*b*.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a cylindrical developer bearer to carry by rotation two-component developer including toner and magnetic carrier particles to a development range where the developer bearer faces a latent image bearer to develop a latent image formed thereon;

a magnetic field generator disposed inside the developer bearer for generating magnetic force;

a developer regulator disposed upstream from the development range in a rotational direction of the developer bearer and facing a circumferential surface of the developer bearer across a regulation gap for adjusting an amount of the developer carried on the developer bearer;

a supply compartment from which the developer is supplied to the developer bearer, the supply compartment disposed adjacent to the developer bearer and extending in an axial direction of the developer bearer;

a developer agitator provided in the supply compartment for transporting the developer in the axial direction of the developer bearer;

a collection compartment to which the developer is collected after the developer passes through the development range;

a pre-regulation portion adjacent to and upstream from the developer regulator in the rotational direction of the developer bearer; and a developer mobility adjuster that makes mobility of the developer in the pre-regulation portion higher on an upstream side in a developer conveyance direction in the supply compartment than on a downstream side in the developer conveyance direction in the supply compartment, wherein:

the magnetic field generator includes multiple magnetic poles arranged in the rotational direction of the developer bearer, the multiple magnetic poles including an attraction pole for attracting the developer from the supply compartment to the circumferential surface of the developer bearer, the attraction pole of the magnetic field generator generates an attractive magnetic flux on the circumferential surface of the developer bearer, and the developer mobility adjuster shifts a peak density position in a direction normal to the circumferential surface of the developer bearer of the attractive magnetic flux on an upstream side in the developer conveyance direction in the supply compartment to a downstream side in the rotational direction of the developer bearer.

2. The development device according to claim 1, wherein the attraction pole of the magnetic field generator acts on the developer that passes through the regulation gap for adjusting the amount of the developer supplied to the development range, and the supply compartment is positioned higher than the developer bearer.

3. The development device according to claim 1, wherein the developer mobility adjuster comprises a magnet disposed outside the developer bearer, the magnet facing the downstream side in the supply compartment in the developer conveyance direction in the supply compartment.

4. The development device according to claim 1, wherein a distal end portion of the developer regulator close to the developer bearer is tapered.

5. A process cartridge comprising:

a latent image bearer on which a latent image is formed; and the development device according to claim 1.

6. An image forming apparatus comprising:

an image forming unit;

a latent image bearer on which a latent image is formed;

and the development device according to claim 1.

7. The development device according to claim 1, wherein:

the developer mobility adjuster makes mobility of the developer in the pre-regulation portion higher on the upstream side in a developer conveyance direction in the supply compartment than on a downstream side in the developer conveyance direction in the supply compartment.

* * * * *